US009433312B2

(12) United States Patent
Cooper

(10) Patent No.: US 9,433,312 B2
(45) Date of Patent: Sep. 6, 2016

(54) CLOTHES CATCHER

(71) Applicant: Rona Cooper, Savannah, GA (US)

(72) Inventor: Rona Cooper, Savannah, GA (US)

( * ) Notice: Subject to any disclaimer, the term of this patent is extended or adjusted under 35 U.S.C. 154(b) by 0 days.

(21) Appl. No.: 14/086,603

(22) Filed: Nov. 21, 2013

(65) Prior Publication Data

US 2015/0136813 A1 May 21, 2015

(51) Int. Cl.

| | |
|---|---|
| ***A47G 25/48*** | (2006.01) |
| ***A47G 25/02*** | (2006.01) |
| ***A47G 25/14*** | (2006.01) |

(52) U.S. Cl.

CPC ..... *A47G 25/48* (2013.01); *A47G 25/02* (2013.01); *A47G 25/14* (2013.01)

(58) Field of Classification Search

CPC ..... A47G 25/00; A47G 25/02; A47G 25/06; A47G 25/0685; A47G 25/14; A47G 25/145; A47G 25/40; A47G 25/48; A41D 27/22; A47F 7/19

USPC ..... 223/85, 88, 89, 90, 91, 94, 95, 96; D6/315, 328; 24/537; 211/4

See application file for complete search history.

(56) References Cited

U.S. PATENT DOCUMENTS

| | | | | | |
|---|---|---|---|---|---|
| 1,573,649 | A * | 2/1926 | Simpson | A47G 25/20 | 223/68 |
| 1,962,851 | A * | 6/1934 | Wiseman | 24/537 | |
| 2,122,617 | A * | 7/1938 | Marshall | 223/92 | |
| 2,202,427 | A * | 5/1940 | Polen | A47B 61/02 | 211/4 |
| 2,335,243 | A * | 11/1943 | Grieshaber | 38/102.1 | |
| 2,383,009 | A * | 8/1945 | Meyer | 223/85 | |
| 3,116,860 | A * | 1/1964 | Urich | 223/85 | |
| 3,381,865 | A * | 5/1968 | Pehr | 223/87 | |
| 3,885,674 | A * | 5/1975 | Rosenberg | E05B 69/006 | 211/4 |
| 4,221,298 | A * | 9/1980 | Wright et al. | 211/4 | |
| 4,265,380 | A * | 5/1981 | Webster et al. | 223/85 | |
| 8,047,410 | B2 * | 11/2011 | Holm et al. | 223/93 | |
| 2013/0313292 | A1 * | 11/2013 | Alley et al. | 223/85 | |

FOREIGN PATENT DOCUMENTS

| | | | |
|---|---|---|---|
| CH | 112940 | * | 4/1926 |
| DE | 4231126 A1 | * | 3/1994 |

* cited by examiner

*Primary Examiner* — Ismael Izaguirre
(74) *Attorney, Agent, or Firm* — Incorporating Innovation LLC; Charlena Thorpe, Esq.

(57) ABSTRACT

Various implementations of this disclosure provide a clothes catcher for holding a hanging portion of a clothing item. In some implementations, the clothes catcher can be used with existing or future developed clothes hangers. In some implementations, the clothes catcher can be used to lift a hanging portion of a long dress or other clothing item when hung from a clothes hanger. In some implementations, the apparatus in integrally connected to a clothes hanger.

12 Claims, 2 Drawing Sheets

CLOTHES CATCHER

TECHNICAL FIELD

This disclosure relates to implementations of a clothes catcher.

BACKGROUND

A closet rod may not be hung high enough to keep a clothing item such as a dress or any hanging item from touching the floor when hung from the rod with a clothes hanger.

DETAILED DESCRIPTION

Various implementations of this disclosure provide a clothes catcher for holding a hanging portion of a clothing item. In some implementations, the clothes catcher can be used with existing or future developed clothes hangers. In some implementations, the clothes catcher can be used to lift a hanging portion of a long dress or other clothing item from the floor when hung on a clothes hanger. In some implementations, the clothes catcher can be used to lift one end of a long dress or other clothing item from any other object (e.g., another closet rod) below the clothing item when hung from a clothes hanger. In some implementations, the apparatus in integrally connected to a clothes hanger.

Figure 1:
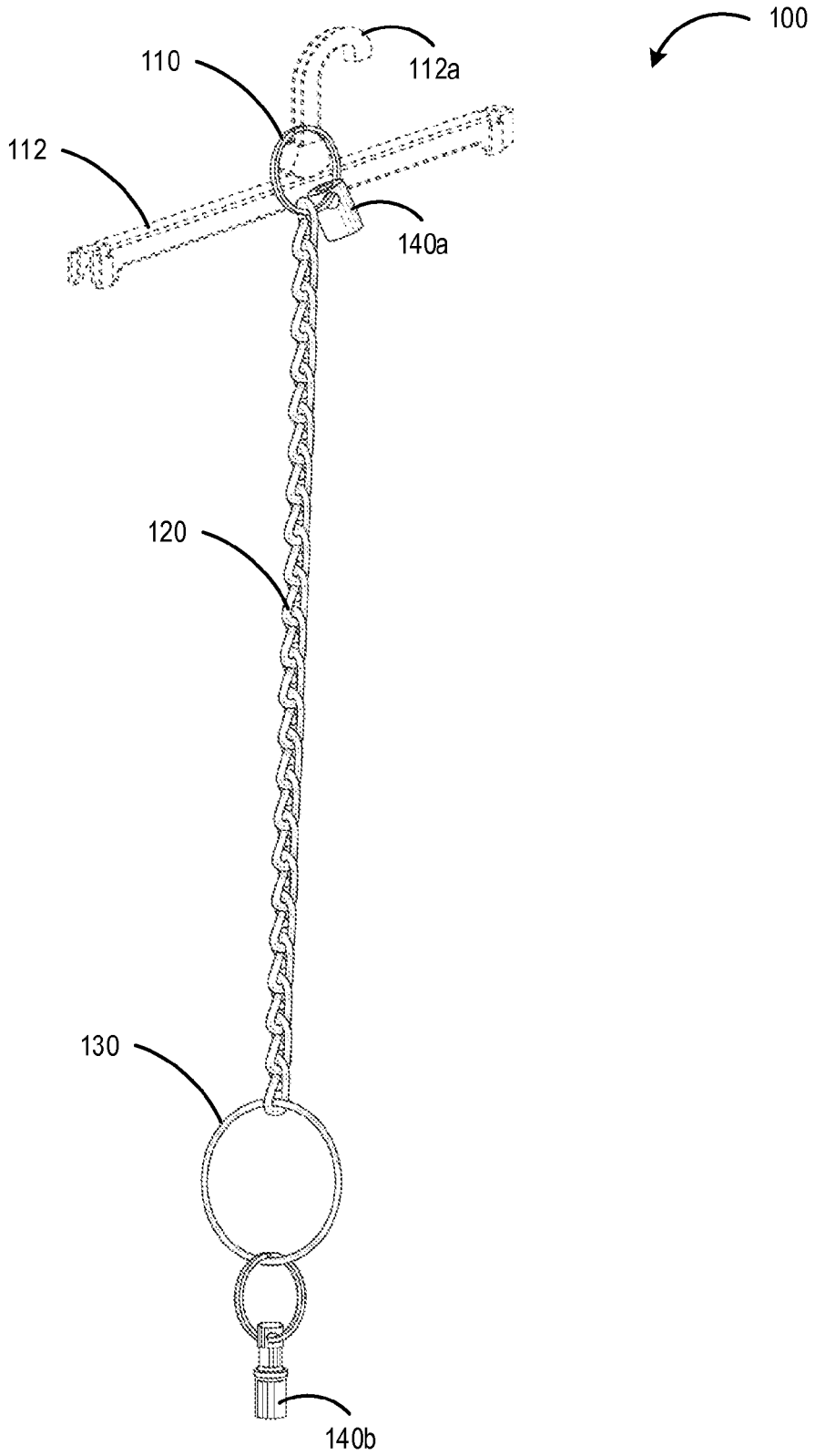
FIG. 1 illustrates an example clothes catcher.

FIG. 1 illustrates an example clothes catcher 100. In some implementations, the clothes catcher 100 includes a connector 110, a chain 120, and a holder 130.

The connector 110 is configured to attach to a clothes hanger 112. Although FIG. 1 illustrates the connector 110 as a loop configured to be placed around the clothes hanger hook 112*a*, the connector can be any device configured to attach anywhere on a clothes hanger.

The first end of the chain 120 is attached to the connector 110 and the second end of the chain 120 is attached to the holder 130. The chain 120 is configured to extend vertically downward when the connector 110 is attached to a clothes hanger. In some implementations, the length of the chain 120 is adjustable. In alternative implementations, the chain 120 can be replaced with a rope, cord, string, cable, wire, line, or any other length of material.

Figure 2:
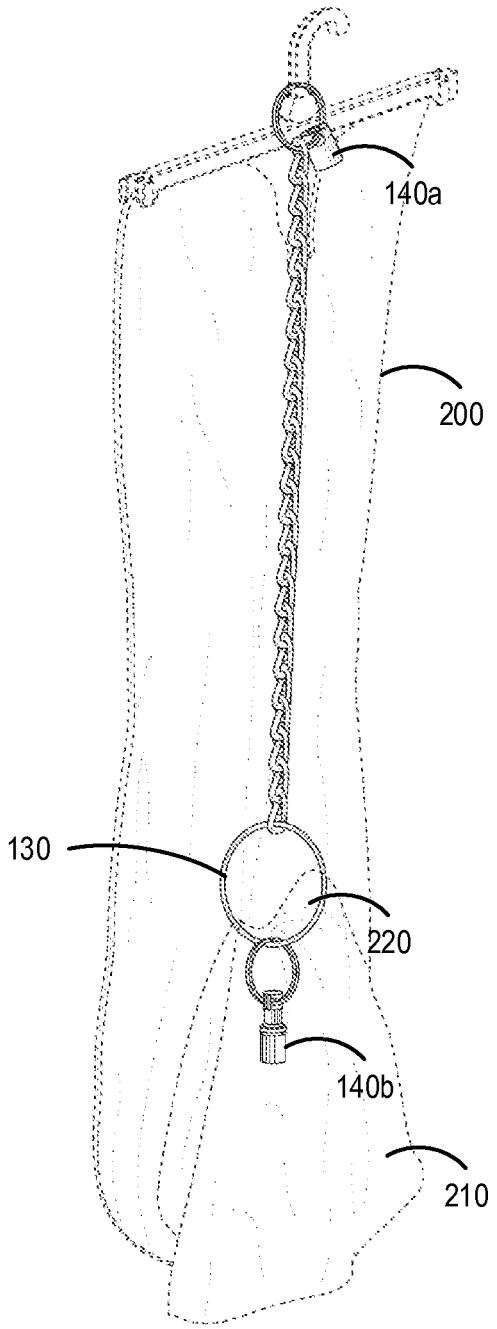
FIGS. 2-3 illustrate using the clothes catcher of FIG. 1 for lifting a hanging portion of a clothing item.

The holder 130 is configured to lift the hanging end of a clothing item being hung from the hanger 112. For example, as shown in FIG. 2, holder 130 can be a loop for inserting the hanging end 210 of a clothing item 200 through such that a hanging portion 220 of the clothing item rest on the loop. In this way, the hanging end 210 of the clothing item maybe lifted. Although FIGS. 1 and 2 illustrate the holder 130 as a loop, the holder can be any device configured to lift the hanging end of a clothing item. In some implementations, the loop holder 130 may be larger in diameter than the loop connector 110.

Figure 3:
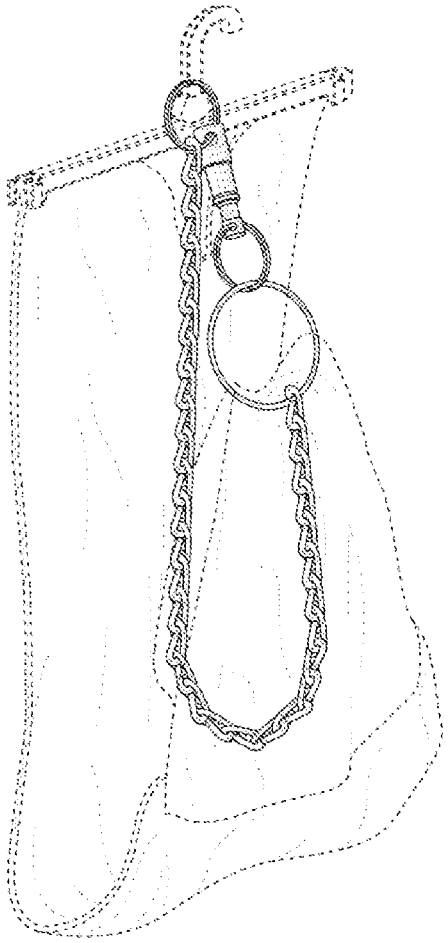

Returning to FIG. 1, in some implementations, when more life is needed, the clothes catcher 100 can include an adjuster having a first part 140*a* and a second part 140*b*. As shown in FIG. 1, is some implementations, the first part 140*a* is connected to the clothes catcher 110 on one end and the second part 140*b* is connected to the clothes catcher 110 on the other end. Comparing FIG. 2 and FIG. 3, the first part 140*a* can be connected to the second part 140*b* to provide further lift of the clothing item. The first part 140*a* and second part 140*b* can be any connecting system or fastener configured to join two ends of an object together. For example, the first part 140*a* and second part 140*b* can be similar technology used for a push-apart or double key ring.

Reference throughout this specification to "an embodiment" or "implementation" or words of similar import means that a particular described feature, structure, or characteristic is included in at least one embodiment of the present invention. Thus, the phrase "in an embodiment" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A apparatus comprising:

a connector configured to attach to a clothes hanger wherein the connector is a loop configured to fit around a hook of the clothes hanger;

a holder having an opening configured to receive a portion of a clothing item when the clothing item is being hung from the clothes hanger in a downwardly direction through the opening such that a portion of the clothing item drapes over a portion of the holder and a distal end of the clothing item extending through the holder hangs past the holder in a downwardly direction; and a flexible and continuous article wherein the first end of the article is attached to the connector and the second end of the article is attached to the holder wherein the article is configured to extend vertically downward when the connector is attached to the clothes hanger.

2. The apparatus of claim 1 wherein the holder is a loop.

3. The apparatus of claim 1 wherein the connector is a first loop and the holder is a second loop.

4. The apparatus of claim 1 wherein the article is a chain.

5. The apparatus of claim 1 wherein the apparatus of claim 1 further comprises an adjuster that is a separate apparatus from the article and having a first part and a second part that are detachable from each other wherein the first part is attached to the connector and the second part is attached to the holder and wherein the first part and the second part are configured to connect together and detach from each other thereby adjusting the lift of the holder.

6. The apparatus of claim 5 wherein the adjuster is a push-apart key ring.

7. The apparatus of claim 5 wherein the article is a chain.

8. A method of using the apparatus of claim 1 comprising:

attaching the apparatus to a clothes hanger using the connector;

hanging a clothing item on the hanger; and lifting a hanging portion of the clothing item using the holder by inserting the hanging portion through an opening of the holder such that a portion of the clothing item drapes over a portion of the holder and a distal end of the clothing item extending through the holder hangs past the holder in a downwardly direction.

9. The method of claim 8 wherein the apparatus of claim 1 further comprises an adjuster that is a separate apparatus from the length of material and having a first part and a second part that are detachable from each other wherein the first part is attached to the connector and the second part is attached to the holder and wherein the first part and the second part are configured to connect together and detach from each other thereby adjusting the lift of the holder, the method further comprising adjusting the apparatus by connecting the first part of the adjuster to the second part of the adjuster.

10. The apparatus of claim 1 wherein the holder is a circular loop configured to receive through the opening of the loop a portion of the clothing item such that a distal end of the clothing item extending through the opening of the loop hangs past the loop in a downwardly direction.

11. A apparatus comprising:

a connector configured to attach to a clothes hanger;

a holder configured to hold a hanging portion of a clothing item being hung from the clothes hanger;

a flexible and continuous article wherein the first end of the article is attached to the connector and the second end of the article is attached to the holder wherein the article is configured to extend vertically downward when the connector is attached to the clothes hanger; and an adjuster that is a separate apparatus from the article and having a first part and a second part that are detachable from each other wherein the first part is attached to the connector and the second part is attached to the holder and wherein the first part and the second part are configured to connect together and detach from each other thereby adjusting the lift of the holder.

12. The apparatus of claim 11 wherein the article is a chain.

* * * * *